US012679607B2

(12) United States Patent
Li

(10) Patent No.: US 12,679,607 B2
(45) Date of Patent: Jul. 14, 2026

(54) FRESH-KEEPING BOX

(71) Applicant: Mingfei Li, Jiexi (CN)

(72) Inventor: Mingfei Li, Jiexi (CN)

( * ) Notice: Subject to any disclaimer, the term of this patent is extended or adjusted under 35 U.S.C. 154(b) by 0 days.

(21) Appl. No.: 19/321,557

(22) Filed: Sep. 8, 2025

(65) Prior Publication Data

US 2026/0001689 A1 Jan. 1, 2026

(30) Foreign Application Priority Data

Sep. 15, 2024 (CN) ..... 202422263614.0

(51) Int. Cl.
*B65D 43/16* (2006.01)

(52) U.S. Cl.
CPC ..... *B65D 43/166* (2013.01); *B65D 2313/04* (2013.01); *B65D 2543/00185* (2013.01); *B65D 2543/00509* (2013.01); *B65D 2543/00546* (2013.01)

(58) Field of Classification Search
CPC ..... B65D 43/166; B65D 2313/04; B65D 2543/00185; B65D 2543/00509; B65D 2543/00546
See application file for complete search history.

(56) References Cited

U.S. PATENT DOCUMENTS 5,135,012 A * 8/1992 Kamen ..... A45C 13/02 206/823
5,582,314 A * 12/1996 Quinn ..... B65D 47/0885 220/849
6,626,291 B2 * 9/2003 Pozzoli ..... G11B 33/0427
7,657,971 B2 * 2/2010 Danko ..... E05D 1/06 220/230
8,317,048 B2 * 11/2012 Hajichristou ..... B65D 43/0225 220/230
2002/0130128 A1 * 9/2002 Berglund ..... B65D 43/167 220/230
2019/0100370 A1 4/2019 Kieling et al.
2023/0232871 A1 7/2023 Wu et al.
2024/0059474 A1 2/2024 Burgess et al.

FOREIGN PATENT DOCUMENTS

CH 658438 A5 * 11/1986 ..... B65D 51/00

OTHER PUBLICATIONS

English translation of CH 658438 provided by Espacenet. (Year: 2025).*

* cited by examiner

*Primary Examiner* — James N Smalley
(74) *Attorney, Agent, or Firm* — Hemisphere Law, PLLC

(57) ABSTRACT

A fresh-keeping box includes a box body and a lid body. Mounting frames and magnetic elements are arranged on surfaces, in contact with each other, of the box body and the lid body. When the lid body seals the box body to form a storage chamber, the magnetic elements at corresponding positions of the two mounting frames are mutually attracted to enable second surfaces of the two mounting frames to abut against each other. The fresh-keeping box is opened and closed magnetically, thus being easy and fast to operate and extremely convenient to use.

7 Claims, 3 Drawing Sheets

FRESH-KEEPING BOX

BACKGROUND OF THE INVENTION

Technical Field

The invention relates to the field of food fresh keeping, in particular to a fresh-keeping box.

Description of Related Art

At present, fresh-keeping boxes are extremely popular because they are convenient to use, capable of preventing food placed therein from coming into contact with the outside by means of a lid and easy to store. There are increasingly more types of fresh-keeping boxes on the market, and all these fresh-keeping box are different. A box body and a box lid of an existing fresh-keeping box are connected by means of buckles. By adopting such a connection method, the inside of the box body cannot be completely sealed, and air from the outside may enter the internal space of the box body, leading to slow spoilage of food; or food may be tainted by other odors when the fresh-keeping box is placed a refrigerator. In addition, the operation of connection with buckles is complex, making the fresh-keeping box inconvenient to use.

BRIEF SUMMARY OF THE INVENTION

Technical Issue to be Settled

The invention provides a fresh-keeping box, which is easy to open and close and capable of being well sealed.

Technical Solution

The invention provides a fresh-keeping box, including:

- a box body and a lid body, wherein mounting frames and magnetic elements are arranged on surfaces, in contact with each other, of the box body and the lid body;
- each mounting frame includes a first surface and a second surface which are arranged oppositely in a thickness direction of the mounting frame;
- each mounting frame is provided with receiving grooves, and openings of the receiving grooves are located in the first surface;
- the magnetic elements are mounted in the receiving grooves, and the box body and the lid body are respectively connected to the first surfaces of the two mounting frames and cover the openings, located in the first surfaces, of the receiving grooves to seal the magnetic elements in the mounting frames;
- wherein, when the lid body seals the box body to form a storage chamber, the magnetic elements at corresponding positions of the two mounting frames are mutually attracted to enable the second surfaces of the two mounting frames to abut against each other.

Preferably, the box body, the lid body and the mounting frames are all made from flexible materials.

Preferably, a convex edge is arranged at a position, corresponding to the second surface, of an inner ring of each mounting frame and extends close to a center of the mounting frame and away from the first surface, and an angle is formed between the convex edge and the inner ring of the mounting frame; and when the second surfaces of the two mounting frames come into contact, the corresponding convex edges of the two mounting frames press against each other.

Preferably, a connector is arranged between the two mounting frames.

Preferably, each mounting frame further includes limit baffles, and the limit baffles are arranged at the openings of the receiving grooves and are opposite to bottoms of the receiving grooves.

Preferably, in a length direction of the receiving grooves, the limit baffles are arranged at middle positions of the openings of the receiving grooves, such that middle positions of the magnetic elements are covered with the limit baffles; and two ends of each magnetic element are uncovered via the opening of the corresponding receiving groove.

Preferably, a periphery of each of the magnetic elements is wrapped with a silicone protective sleeve.

The fresh-keeping box provided by the invention has the following beneficial effects:

1. The fresh-keeping box is opened and closed magnetically, thus being easy and fast to operate and extremely convenient to use.

2. By arranging the convex edges on the inner rings of the mounting frames, the sealing effect is further improved, and soup is unlikely to spill out of the fresh-keeping box.

DETAILED DESCRIPTION OF THE INVENTION

The invention is described in further detail below in conjunction with accompanying drawings and embodiments, and those skilled in the art may implement the invention with reference to the description.

Embodiment 1

Figure 1:
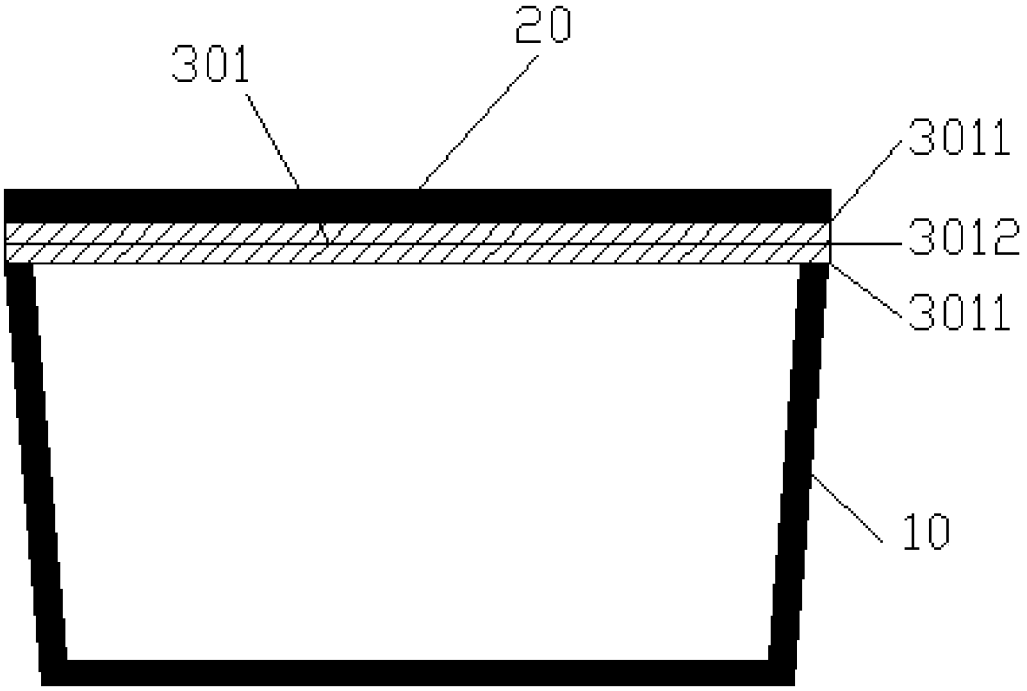
FIG. 1 is a structural diagram of a fresh-keeping box according to the invention.
Figure 2:
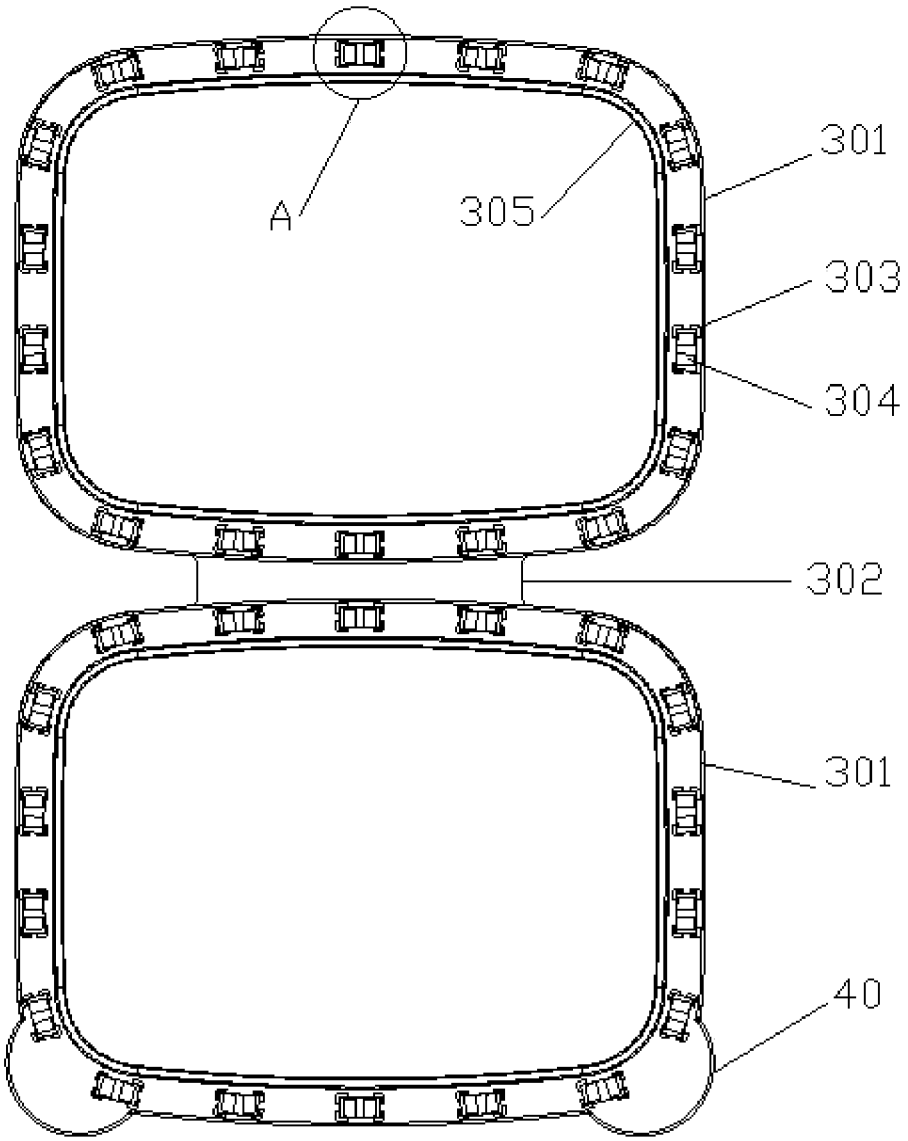
FIG. 2 is a structural diagram of mounting frames of the fresh-keeping box according to the invention.
Figure 3:
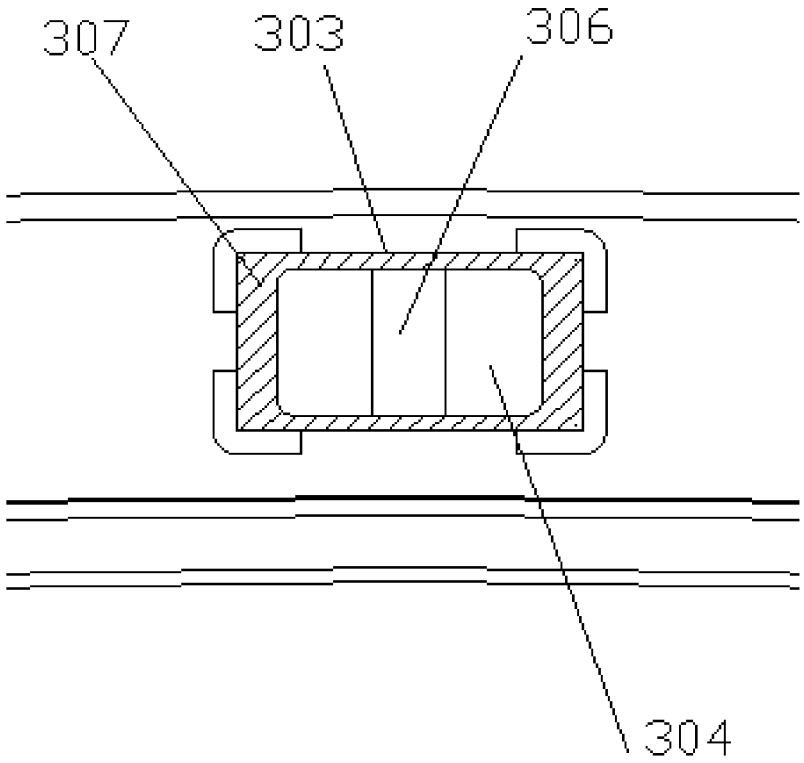
FIG. 3 is an enlarged view of part A in FIG. 2.

As shown in FIGS. 1 and 2, a fresh-keeping box includes a box body 10 and a lid body 20. Pull rings 40 are arranged on an edge of the lid body 20. Mounting frames 301 and magnetic elements 304 are arranged on surfaces, in contact with each other, of the box body 10 and the lid body 20. A connector 302 is mounted between the two mounting frames 301.

Each mounting frame 301 includes a first surface 3011 and a second surface 3012 which are arranged oppositely in a thickness direction of the mounting frame 301.

Each mounting frame 301 is provided with receiving grooves 303, and openings of the receiving grooves 303 are located in the first surface 3011.

The magnetic elements 304 are mounted in the receiving grooves 303, and the box body 10 and the lid body 20 are respectively connected to the first surfaces 3011 of the two mounting frames 301 and cover the openings, located in the first surfaces 3011, of the receiving grooves 303 to seal the magnetic elements 304 in the mounting frames 301.

Wherein, when the lid body 20 seals the box body 10 to form a storage chamber, the magnetic elements 304 at corresponding positions of the two mounting frames 301 are mutually attracted to enable the second surfaces 3012 of the two mounting frames 301 to abut against each other.

When the fresh-keeping box needs to be opened, a user holds the box body and the pull rings with two hands respectively to forcibly separate the lid body from the box body. When the fresh-keeping box needs to be closed, the user just needs to push the lid body to rotate above the box body, and at this moment, the connector fulfills a guide effect; and when the distance between the box body and the lid body reaches a critical magnetic distance between the magnetic elements, the two mounting frames are automatically fastened together and abut against each other, such that the lid body covers and seals the box body.

Embodiment 2

As shown in FIGS. 1 and 2, a fresh-keeping box includes a box body 10 and a lid body 20. Pull rings 40 are arranged on an edge of the lid body 20. Mounting frames 301 and magnetic elements 304 are arranged on surfaces, in contact with each other, of the box body 10 and the lid body 20. A connector 302 is arranged between the two mounting frames 301.

Each mounting frame 301 includes a first surface 3011 and a second surface 3012 which are arranged oppositely in a thickness direction of the mounting frame 301.

Each mounting frame 301 is provided with receiving grooves 303, and openings of the receiving grooves 303 are located in the first surface 3011.

A convex edge 305 is arranged at a position, close to the second surface 3012, of an inner ring of each mounting frame 301 and extends close to the center of the mounting frame 301 and away from the first surface 3011, and an angle is formed between the convex edge 305 and the inner ring of the mounting frame 301; and when the second surfaces 3012 of the two mounting frames 301 come into contact, the corresponding convex edges 305 of the two mounting frames 301 press against each other.

The magnetic elements 304 are mounted in the receiving grooves 303, and the box body 10 and the lid body 20 are respectively connected to the first surfaces 3011 of the two mounting frames 301 and cover the openings, located in the first surfaces 3011, of the receiving grooves 303 to seal the magnetic elements 304 in the mounting frames 301.

Wherein, when the lid body 20 seals the box body 10 to form a storage chamber, the magnetic elements 304 at corresponding positions of the two mounting frames 301 are mutually attracted to enable the second surfaces 3012 of the two mounting frames 301 to abut against each other.

When the fresh-keeping box needs to be opened, a user holds the box body and the pull rings with two hands respectively to forcibly separate the lid body from the box body. When the fresh-keeping box needs to be closed, the user just needs to push the lid body to rotate above the box body, and at this moment, the connector fulfills a guide effect; and when the distance between the box body and the lid body reaches a critical magnetic distance between the magnetic elements, the two mounting frames are automatically fastened together and abut against each other, such that the lid body covers and seals the box body.

After the corresponding convex edges 305 of the two mounting frames 301 press against each other, the inside of the box body is further sealed. When liquid food is stored in the box body, the two convex edges 305 will press against each other more tightly under the action of the gravity of the liquid food, thus further improving the sealing effect.

Embodiment 3

As shown in FIGS. 1 and 2, a fresh-keeping box includes a box body 10 and a lid body 20. Pull rings 40 are arranged on an edge of the lid body 20. Mounting frames 301 and magnetic elements 304 are arranged on surfaces, in contact with each other, of the box body 10 and the lid body 20. A connector 302 is arranged between the two mounting frames 301.

Each mounting frame 301 includes a first surface 3011 and a second surface 3012 which are arranged oppositely in a thickness direction of the mounting frame 301.

Each mounting frame 301 is provided with receiving grooves 303, and openings of the receiving grooves 303 are located in the first surface 3011.

The magnetic elements 304 are mounted in the receiving grooves 303, and the box body 10 and the lid body 20 are respectively connected to the first surfaces 3011 of the two mounting frames 301 and cover the openings, located in the first surfaces 3011, of the receiving grooves 303 to seal the magnetic elements 304 in the mounting frames 301.

Wherein, when the lid body 20 seals the box body 10 to form a storage chamber, the magnetic elements 304 at corresponding positions of the two mounting frames 301 are mutually attracted to enable the second surfaces 3012 of the two mounting frames 301 to abut against each other.

Each mounting frame 301 further includes limit baffles 306, the limit baffles 306 are arranged at the openings of the receiving grooves 303 and are opposite to the bottoms of the receiving grooves 303, and in a length direction of the receiving grooves 303, the limit baffles 306 are arranged at middle positions of the openings of the receiving grooves 303, such that middle positions of the magnetic elements 304 are covered with the limit baffles 306; and two ends of each magnetic element 304 are uncovered via the opening of the corresponding receiving groove 303.

The box body 10, the lid body 20 and the mounting frames 301 are all made from flexible materials. When the fresh-keeping box needs to be opened, a user just needs to open one corner of the lid body 20 by hand, and because the lid body 20 is a flexible structure, the lid body 20 may be gradually separated from the box body 10. In this way, the fresh-keeping box may be opened with less effort, and the situation where food spills out of the fresh-keeping box due to an excessive force applied for opening the box is avoided. Further, because the magnetic elements 304 have a specific length, if the lid body 20 is a rigid structure, the force applied for opening the lid body 20 should be greater than the attractive force between the magnetic elements 304, and at the moment the box is opened, food in the box body 10 may spill out due to excessive inertia of hands caused by an excessive force. By designing the lid body 20 into a flexible structure, the force applied for opening one corner of the lid body 20 just needs to be part of the attractive force of the magnetic elements 304 and will become smaller gradually in the continuous opening process, such that the box may be opened with less effort.

Although the embodiments of the invention have been disclosed above, the invention is not limited to the applications in the above description and embodiments and may be applied to various suitable fields. For those skilled in the art, other modifications may be achieved easily. Thus, under the condition of not deviating from the general concept defined by the claims and their equivalents, the invention is not limited to specific details and drawings illustrated and described here.

What is claimed is:

1. A fresh-keeping box, comprising:

a box body, comprising a first mounting frame including a box first frame surface, and a plurality of box magnets located in the box first frame surface; and a lid body, comprising a second mounting frame including a lid first frame surface, and a plurality of lid magnets located in the lid first frame surface;

each said mounting frame is provided with receiving grooves, and openings of the receiving grooves are located in the first surface;

the magnetic elements are mounted in the receiving grooves, and the box body and the lid body are respectively connected to the first surfaces of the two mounting frames and cover the openings, located in the first surfaces, of the receiving grooves to seal the magnetic elements in the mounting frames;

wherein, when the lid body seals the box body to form a storage chamber, the magnetic elements at corresponding positions of the two mounting frames are mutually attracted to enable the second surfaces of the two mounting frames to abut against each other;

wherein each said mounting frame further comprises limit baffles, and the limit baffles are arranged at the openings of the receiving grooves and are opposite to bottoms of the receiving grooves.

2. The fresh-keeping box according to claim 1, wherein the box body, the lid body and the mounting frames are all made from flexible materials.

3. The fresh-keeping box according to claim 1, wherein a concave edge is arranged at a position, corresponding to the second surface, of an inner ring of each said mounting frame and extends close to a center of the mounting frame and away from the first surface, and an angle is formed between the concave edge and the inner ring of the mounting frame; and when the second surfaces of the two mounting frames come into contact, the corresponding concave edges of the two mounting frames are simply vertically aligned.

4. The fresh-keeping box according to claim 1, wherein a connector is arranged between the two mounting frames.

5. The fresh-keeping box according to claim 1, wherein in a length direction of the receiving grooves, the limit baffles are arranged at middle positions of the openings of the receiving grooves, such that middle positions of the magnetic elements are covered with the limit baffles; and two ends of each said magnetic element are uncovered via the opening of the corresponding receiving groove.

6. The fresh-keeping box according to claim 1, wherein a pull ring is arranged on an edge of the lid body.

7. The fresh-keeping box according to claim 1, wherein a periphery of each of the magnetic elements is wrapped with a silicone protective sleeve.

* * * * *